US010214942B2

(12) United States Patent
Lai

(10) Patent No.: US 10,214,942 B2
(45) Date of Patent: Feb. 26, 2019

(54) ZIPPER PADLOCK WITH A DUAL LOCKING SYSTEM

(71) Applicant: THE SUN LOCK COMPANY, LTD., Tuen Mun, N. T. (HK)

(72) Inventor: Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 26 days.

(21) Appl. No.: 15/442,856

(22) Filed: Feb. 27, 2017

(65) Prior Publication Data

US 2017/0284127 A1 Oct. 5, 2017

Related U.S. Application Data

(60) Provisional application No. 62/315,164, filed on Mar. 30, 2016.

(51) Int. Cl.

| | |
|---|---|
| ***E05B 65/52*** | (2006.01) |
| ***E05B 17/04*** | (2006.01) |
| ***E05B 13/10*** | (2006.01) |
| ***E05B 67/38*** | (2006.01) |

(Continued)

(52) U.S. Cl.

CPC ..... *E05B 65/52* (2013.01); *E05B 13/101* (2013.01); *E05B 17/045* (2013.01);

(Continued)

(58) Field of Classification Search

CPC .. E05B 65/52; E05B 65/5207; E05B 65/5215; E05B 65/5223; E05B 65/523;

(Continued)

(56) References Cited

U.S. PATENT DOCUMENTS 3,319,743 A * 5/1967 Pelavin ..... A44B 19/301 70/68
3,597,945 A * 8/1971 Feinberg ..... E05B 37/02 70/68

(Continued)

FOREIGN PATENT DOCUMENTS

| | | |
|---|---|---|
| CN | 1183506 | 6/1998 |
| CN | 2408191 | 11/2000 |
| DE | 2980322 | 6/2000 |

OTHER PUBLICATIONS

Combined Search and Examination Report GB Patent Application No. 1704247.4 Completed: Jul. 28, 2017 6 pages.

*Primary Examiner* — Christopher J Boswell
(74) *Attorney, Agent, or Firm* — Ware, Fressola, Maguire & Barber LLP

(57) ABSTRACT

A zipper lock has a combination locking system defined by dials and clutches and a key overriding mechanism. The lock has a pole to receive zipper pullers and a movable cover plate to block the pole when the lock is in the locked mode. The lock has a control plate with release slots. The control plate can be shifted only if the dials are set to the correct combination or when a correct key is used to turn a tumbler cylinder. The cover plate is engaged with a latch having a latch finger. When the lock is in the locked mode, the latch finger is blocked by the control plate, restricting movement of the latch. When the lock is in the unlocked mode, the latch finger can be moved into a release slot, allowing the latch and cover plate to move in order to clear the pole.

12 Claims, 19 Drawing Sheets

(51) Int. Cl.
*E05B 37/00* (2006.01)
*E05B 37/14* (2006.01)
*E05B 67/36* (2006.01)
*E05B 37/12* (2006.01)

(52) U.S. Cl.
CPC ..... *E05B 37/0034* (2013.01); *E05B 37/12* (2013.01); *E05B 37/14* (2013.01); *E05B 67/36* (2013.01); *E05B 67/383* (2013.01)

(58) Field of Classification Search
CPC .. E05B 65/5246; E05B 65/5284; E05B 67/38; E05B 67/383
See application file for complete search history.

(56) References Cited

U.S. PATENT DOCUMENTS 3,965,706 A * 6/1976 Davis ..... A44B 19/301 70/68
4,366,684 A * 1/1983 Bako ..... E05B 37/02 70/312
5,485,734 A 1/1996 Yang
5,927,113 A * 7/1999 Yu ..... E05B 37/14 70/312
6,408,660 B1 6/2002 Lai
6,513,356 B1 2/2003 Yang
6,912,880 B2 7/2005 Ling et al.
7,415,853 B2 8/2008 Yu
7,562,545 B2 7/2009 Lai et al.
8,096,150 B2 1/2012 Lai et al.
8,113,024 B2 2/2012 Yang
8,161,778 B1 4/2012 Ma
8,661,861 B2 3/2014 Lai
2004/0237605 A1 12/2004 Lin et al.
2005/0072196 A1 4/2005 Ling et al.
2008/0087049 A1 4/2008 Lai et al.
2008/0236212 A1 10/2008 Ma

* cited by examiner

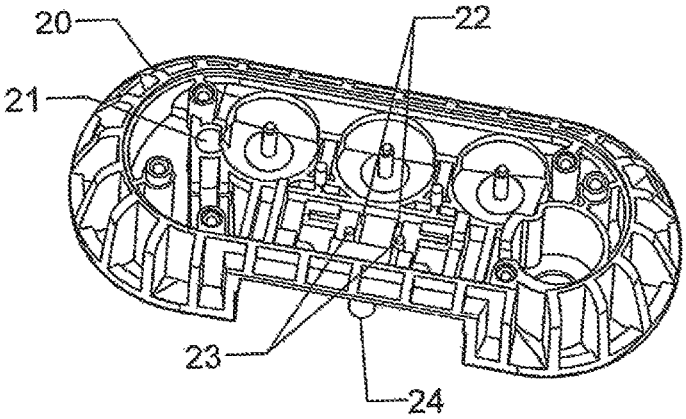
FIG. 2
FIG.3A
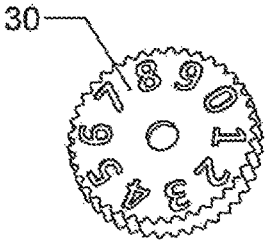
FIG.3B
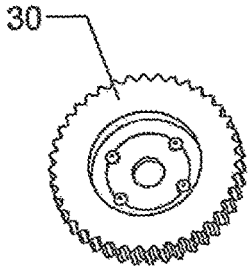
FIG. 4A
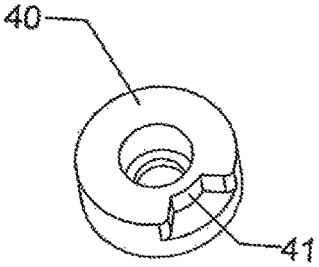
FIG.4B
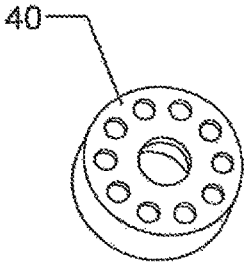

FIG.14
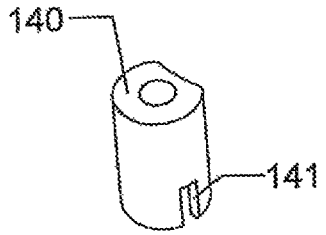
FIG.15
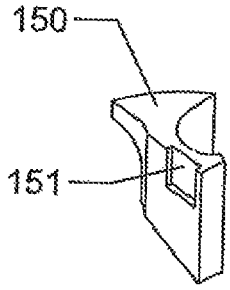
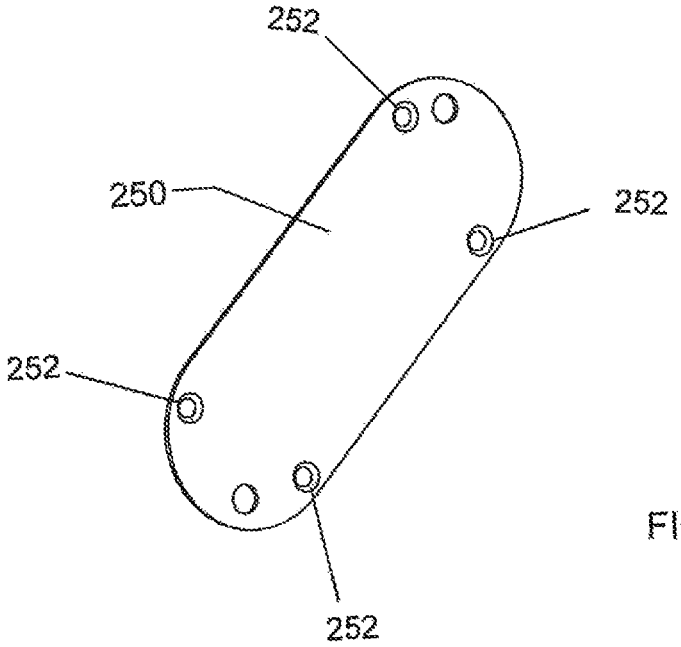
FIG. 16

ZIPPER PADLOCK WITH A DUAL LOCKING SYSTEM

CROSS-REFERENCE TO RELATED APPLICATION

This application claims priority to U.S. Provisional Application No. 62/315,164, filed Mar. 30, 2016, which is hereby incorporated by reference in its entirety.

BACKGROUND OF THE INVENTION

1. Field of the Invention

This invention relates to locks and, more particularly, to a zipper lock with a dual locking system.

2. Description of Related Art

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which make the combination for releasing the lock. Typically, the combination lock has one mode or position in which the user is able to set or reset the desired combination sequence.

One common problem which has consistently plagued lock constructions is the cost of construction for producing and assembling padlocks, whether the padlock is key operated or combination operated. In order to attain a padlock which provides all of the features desired by consumers, prior art constructions typically incorporate numerous small components, each of which require expensive assembly procedures to produce the final product. As a result, these lock constructions are expensive to produce.

The present invention provides a padlock system having a fully integrated dual locking construction which is configured for securing the zipper pulls of a suitcase thereto. The dual locking, zipper pull padlock is easily produced in a cost effective manner.

SUMMARY OF THE INVENTION

The present invention is an integrated zipper padlock which is designed to be mounted on a zipper case via zipper pullers, and the padlock can be opened by a combination (open lock combination) and by a key overriding mechanism. The combination locking system is partially similar to that described in U.S. Pat. No. 8,661,861 which is assigned to The Sun Lock Company Ltd., the assignee of the present invention and is hereby incorporated by reference in its entirety. In particular, both the present invention and U.S. Pat. No. 8,661,861 use a control plate having a plurality of protrusions for engagement with a plurality of clutches to operate the padlock in a locked mode or an unlocked mode. Also, both the present invention and U.S. Pat. No. 8,661,861 use a disc tumbler cylinder in the key overriding mechanism.

Thus, an aspect of the present invention is a lock at least operable in a locked mode and an unlocked mode, comprising:

a lock body;

a pole formed in the lock body;

a cover plate movable in a first movement direction between a first plate position to block the pole and a second plate position to clear the pole;

a latch engageable with the cover plate for movement together in the first movement direction; and a control plate movable in a second movement direction between a first plate position and a second plate position, wherein when the control plate is located in the first plate position, the control plate is configured to restrict movement of the latch and the cover plate, and when the control plate is located in the second plate position, the cover plate is allowed to move from the first cover position to the second cover position together with the latch so as to change the lock from the locked mode to the unlocked mode, wherein the second movement direction is substantially perpendicular to the first movement direction.

According to embodiments of the present invention, the latch comprises a latch plate and a latch finger extended from the latch plate, and the cover plate comprises a blocking wall and a release slot, the release slot dimensioned to receive the latch finger, wherein when the control plate is located in the first plate position, the block wall is configured to contact with the latch finger, preventing the latch from moving in the first movement direction, and when the control plate is located in the second plate position, the blocking wall is spaced from the latch finger and the release slot is aligned with the latch finger so as to allow the latch to move in the first movement direction.

According to embodiments of the present invention, the control plate comprises a plate spring and a plurality of plate protrusions, and the lock further comprises:

a plurality of rotatable clutches, each associated with one of the plate protrusions, each clutch having a notch formed therein configured to receive the associated plate protrusion, wherein when the notch in each of the clutches is aligned with the associated plate protrusion, the plate spring is configured to urge the control plate to move from the first plate position to the second plate position, and when the notch in any one of the clutches is misaligned with the associated plate protrusion, the control plate is prevented from movement.

According to embodiments of the present invention, the lock further comprises:

an anchoring block movably engaged with the latch, the anchoring block having a block surface and a surface protrusion extended from the block surface, wherein the latch plate has a groove formed therein configured to engage with the surface protrusion so as to restrict movement of the anchoring block relative to the latch in the first movement direction, the groove configured to allow the anchoring block to move relative to the latch in the second direction while the groove is engaged with the surface protrusion.

According to embodiments of the present invention, the lock further comprises:

two guiding pins fixedly formed in the lock body in relationship to the pole, and two sliding plates, each sliding plate having a slot formed therein dimensioned to slidably engage with a different one of the guiding pins for movement in the second movement direction, each of the sliding plates further having a first sliding edge and a second sliding edge, wherein the cover plate comprises two locking-slope surfaces, each locking-sloping surface arranged to contact with the first sliding edge of a different one of the sliding plates, and wherein when the cover plate is caused to move in the first direction away from the pole, the sliding plates are caused to move closer to each other in the second direction, and wherein the anchoring block comprises two slope edges, each slope edge arranged to contact with the second sliding edge of a different one of the sliding plates and when the sliding plates are caused to move closer to each in the second direction, the anchoring block is also caused to move in the first direction away from the pole.

According to embodiments of the present invention, when the control plate is located in the first plate position, the latch is prevented from moving in the first movement direction together with the anchoring block, and the sliding plates are prevented from moving closer to each other in the second direction so as to prevent cover plate from moving away from the pole in the first movement direction, and when the control plate is located in the second plate position, the latch is allowed to move in the first movement direction together with the anchoring block, and the sliding plates are allowed to move closer to each other in the second direction so as to cause the cover plate to move from the first pate position to the second plate position to clear the pole.

According to embodiments of the present invention, the lock further comprises a spring arranged to urge the anchoring block against movement in the first movement direction so as to keep the cover plate in the first plate position when the lock is operated in the unlocked mode.

According to embodiments of the present invention, the control plate further comprises a further release slot dimensioned to receive the latch finger, the lock further comprising:

a key overriding mechanism configured to move the latch plate in the second movement direction relative to the control plate when the lock is operated in the locked mode so as to move the latch finger away from the blocking wall and into alignment with the further release slot, allowing the latch to move in the first movement direction.

According to embodiments of the present invention, the key overriding mechanism comprises a tumbler cylinder and a linking plate movably connected to the tumbler cylinder, the linking plate comprising a cutout formed therein configured to receive the latch plate, the tumbler cylinder rotatable between a first cylinder position and a second cylinder position, wherein when the tumbler cylinder is maintained in the first cylinder position, the latch finger is positioned to contact with the blocking wall, and when the tumbler cylinder is caused to move from the first cylinder position to the second cylinder position, the linking plate is configured to move the latch plate into alignment with the further release slot.

According to embodiments of the present invention, the tumbler cylinder has a tumbler surface and a pin fixedly formed on the surface, and the linking plate further comprises a slot configured to movably engage with the pin, and wherein when the tumbler cylinder is caused to move from the first cylinder position to the second cylinder position, the pin is configured to move the linking plate in the second movement direction together with the latch plate.

According to embodiments of the present invention, the lock further comprises:

a plurality of clutch springs; and a plurality of dials, each of the dials associated with a different one of the clutches, wherein the clutch springs are configured to urge the clutches against the associated dials so that a rotational movement of the dial is transferred to the associated clutch when the lock is operated in the locked mode, wherein each of the dials comprises a substantially circular disc having indicia thereon and the indicia on the dials are arranged to a combination code for operating the lock in the unlocked mode.

According to embodiments of the present invention, the lock is configured to securely retain at least one zipper pull tab of a zipper case, wherein the at least one zipper pull tab comprises an opening formed therein, the opening dimensioned for insertion onto the pole when the cover plate is located in the second plate position to clear the pole, and wherein when the cover plate is located in the first plate position, the cover plate is configured to securely retain the at least one zipper pull tab to the lock.

BRIEF DESCRIPTION OF THE DRAWINGS

For a fuller understanding of the nature and object of the present invention, reference is made to the following detailed description in connection with the following drawings, in which:

FIG. 2 is a perspective bottom view of the padlock without movable components installed therein.

FIG. 3A is a top perspective view of a dial of the padlock.

FIG. 3B is a bottom perspective view of the dial shown in FIG. 3A.

FIG. 4A is a top perspective view of a clutch of the padlock.

FIG. 4B is a bottom perspective view of the clutch shown in FIG. 4A.

FIG. 14 is a perspective view of a plug forming part of the padlock.

FIG. 15 is a perspective view of a insert plate forming part of the padlock.

FIG. 16 is a perspective view of a base plate forming part of the padlock.

DETAILED DESCRIPTION OF THE INVENTION

Figure 1A:
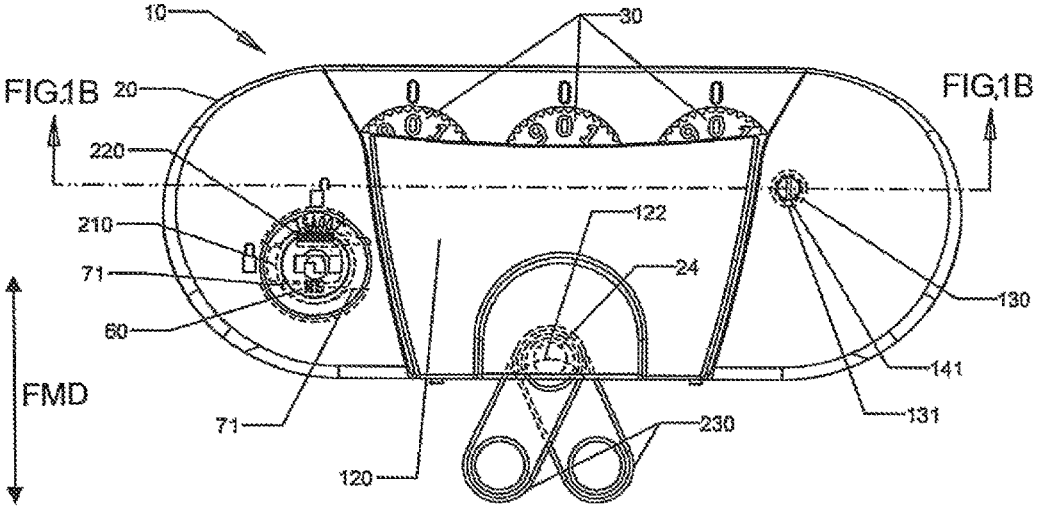
FIG. 1A is a top view of an integrated zipper lock according to an embodiment of the present invention.

The present invention will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

The present invention is an integrated zipper padlock that can be used to lock a zipper case. The lock has a combination locking system and a key overriding mechanism. The combination locking system uses a plurality of dial/clutch pairs to keep the lock in the locked mode. The key overriding mechanism uses a disc tumbler cylinder which can be turned by a correct key to unlock the lock. The lock has a fixture pole dimensioned to receive one or more zipper pulls of the zipper case. The lock has a cover plate having a blocking area to block the fixture pole so that the zipper pulls placed onto the fixture pole cannot be removed in order to secure the zipper case when the lock is operated in a locked mode. When the dial/clutch pairs are set to a correct combination or when a correct key is used on the disc tumbler cylinder, the cover plate can be pulled away to clear the fixture pole, changing the lock from the locked mode to an unlocked mode.

Locked Mode (FIGS. 1A-16)

FIG. 1A shows the top view of a zipper lock 10, according to an embodiment of the present invention. As seen in FIG. 1A, the lock 10 has a lock body 20 and a fixture pole 24 formed on the lock body 20. A cover plate 120 having a blocking area 122 arranged to block the fixture pole 24. The fixture pole 24 is dimensioned to receive one or more zipper pullers 230 of a zipper case (not shown). When the lock 10 is operated in the locked mode, the cover plate 120 cannot be moved away from the fixture pole 24. As such, the blocking area cannot clear the fixture pole 24 to allow the zipper pullers 230 to be removed. The movement direction of the cover plate 120 is herein referred to as a first movement direction (FMD).

Figure 1B:
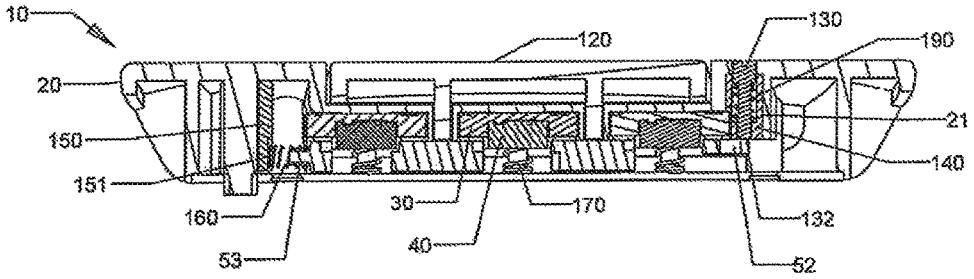
FIG. 1B is a cross-sectional view of the padlock taken along line 1B-1B of FIG. 1A.

As seen in FIGS. 1A-1E, the lock 10 has a number of clutches 40 and a number of dials 30. Each of the dials 30 is engaged to a different clutch 40 so that rotational movement of each of the dials 30 is transferred to the associated clutch 40. Each of the dials 30 has a plurality of indicia (see FIG. 3A) for forming a combination code. Each of the clutches 40 has a notch 41 formed therein. The lock 10 also has a latch 90 and a control plate 50. The latch 90 has a latch plate 93 with a latch groove 92 formed in the latch plate 93 and a latch finger 91 extended from the latch plate 93. The control plate 50 has a number of plate protrusions 51, each of which is arranged to move into the notch 41 of a different clutch 40. The control plate 50 has a first release slot 54, a second release slot 55 and a blocking wall 56 located between the first release slot 54 and the second release slot 55. When the lock 10 is operated in the locked mode, the control plate 50 is restricted from moving and the plate protrusions 51 cannot move toward the notches 41 of the clutches 40. At this position of the control plate 50, the latch finger 91 of the latch 90 is in contact with the blocking wall 56 which restricts the movement of the latch 90 in the first movement direction. The movement direction of the control plate 50 is herein referred to as a second movement direction (SMD), which is substantially perpendicular to the first movement direction. The control plate 50 has a spring pole 53. The lock 10 has a spring 160 mounted over the spring pole 53, arranged to urge the control plate 50 to move in the second movement direction. As seen in FIG. 1B, the lock 10 has an insert plate 150 positioned in relationship to the spring pole 53. As seen in FIG. 15, the insert plate 150 has a wall 151 configured to support the spring 160.

Figure 1C:
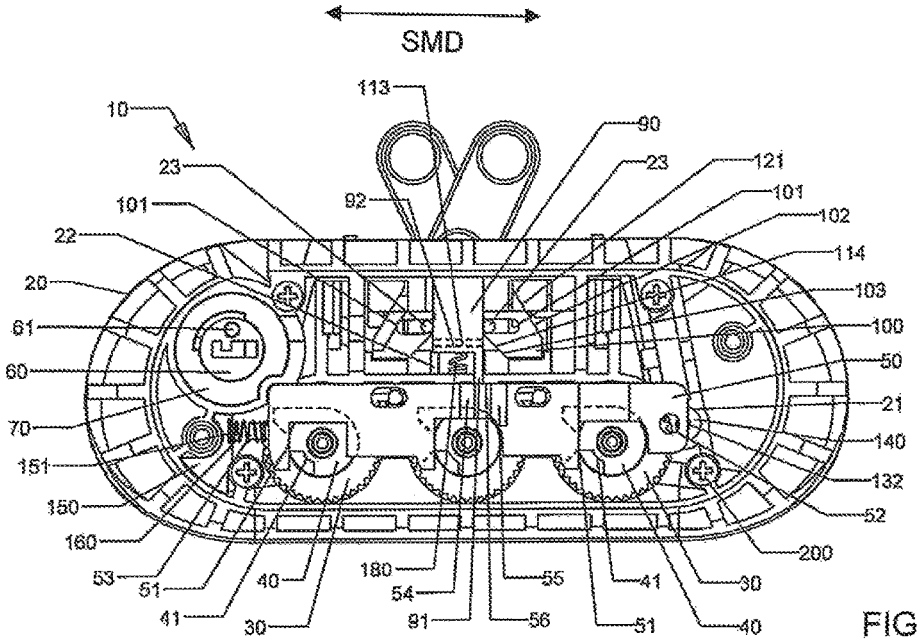
FIG. 1C is a bottom view of the padlock showing the interior components.
Figure 1D:
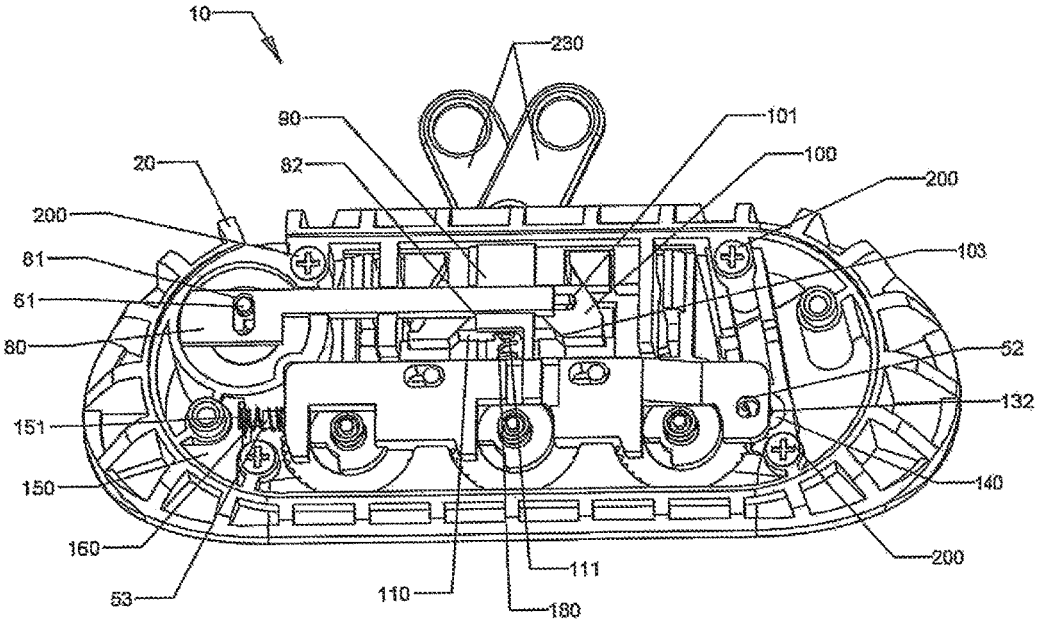
FIG. 1D is another bottom view of the padlock showing additional features of the present invention.
Figure 1E:
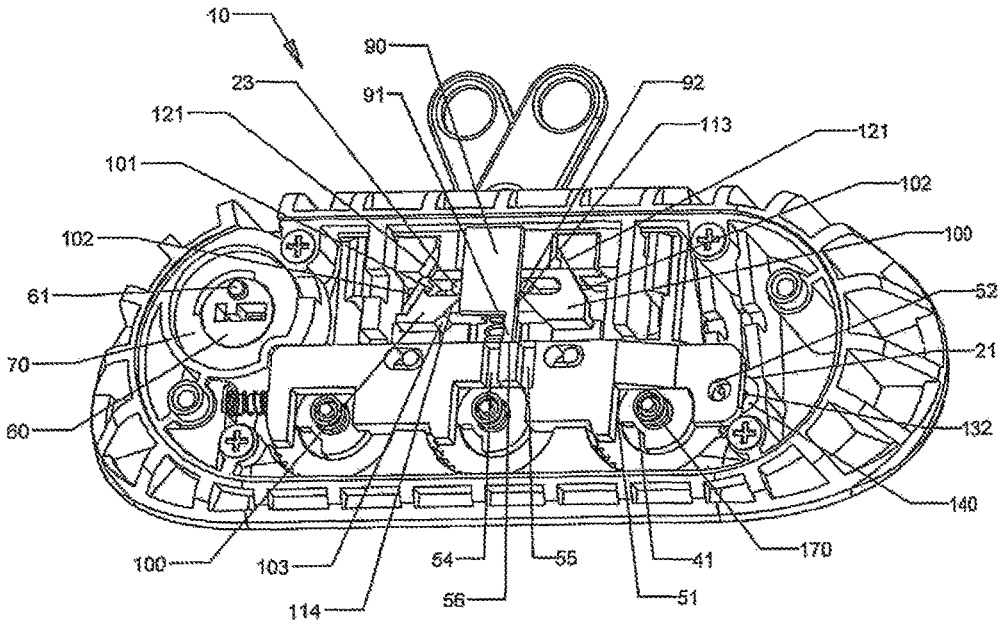
FIG. 1E is a still further bottom view of the padlock showing additional features of the present invention.
Figure 1F:
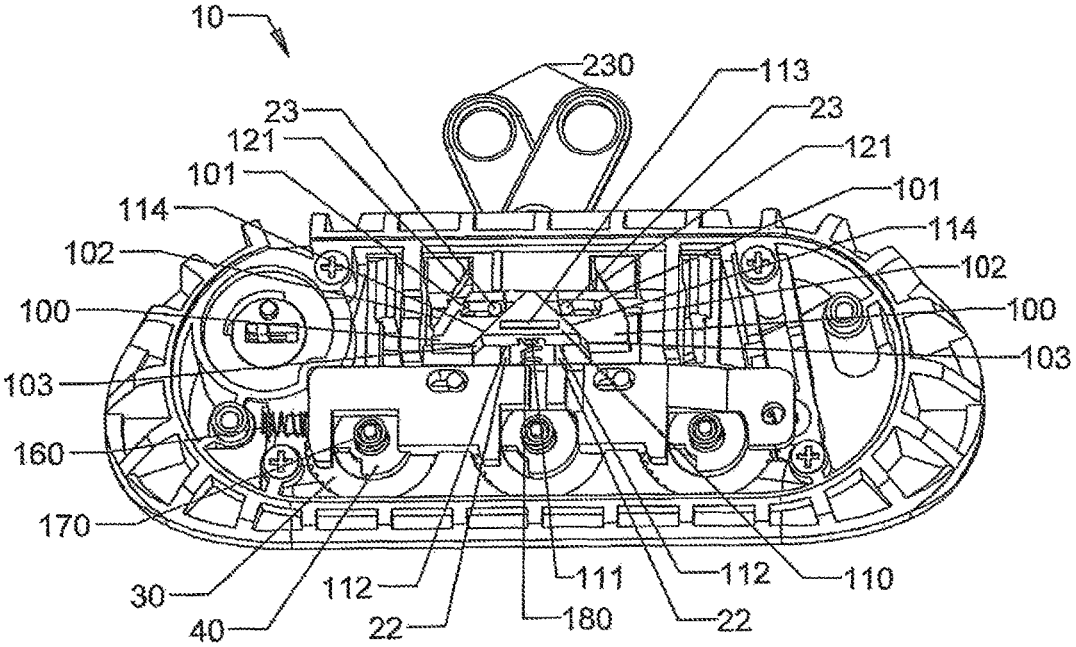
FIG. 1F is another bottom view of the padlock showing additional features of the present invention.
Figure 5A:
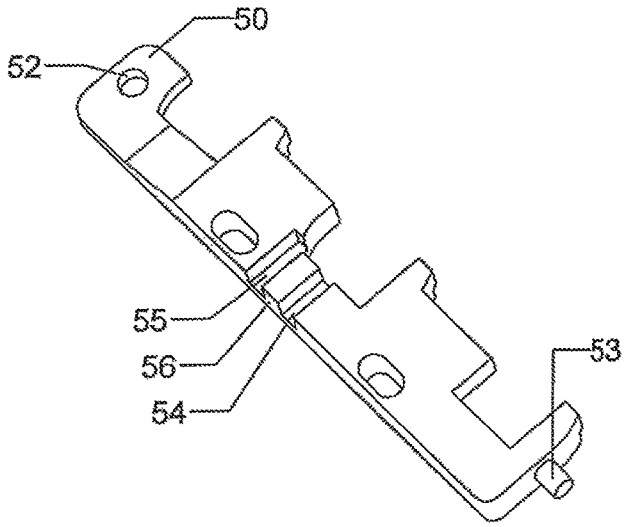
FIG. 5A is a top perspective view of the control plate forming part of the padlock.
Figure 5B:
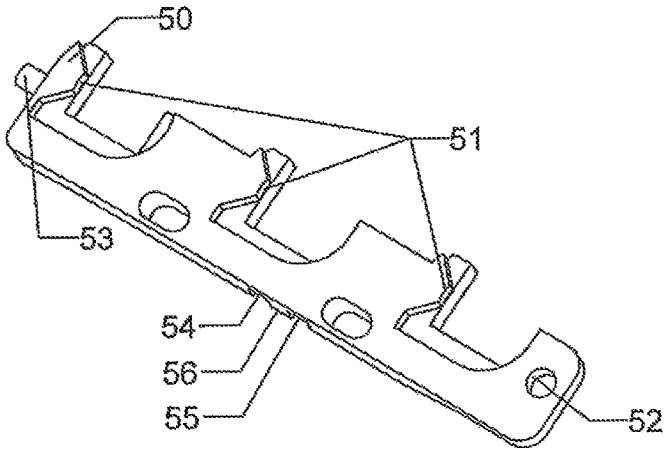
FIG. 5B is a bottom perspective view of the control plate shown in FIG. 5A.
Figure 11A:
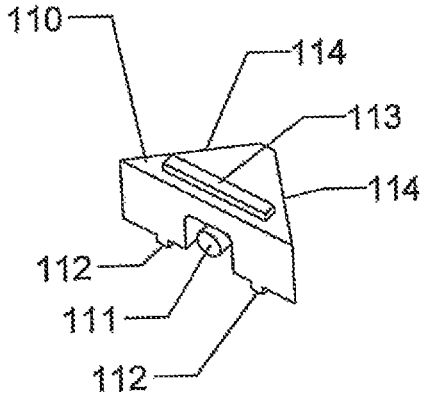
FIG. 11A is a top perspective view of the anchoring block forming part of the padlock.
Figure 11B:
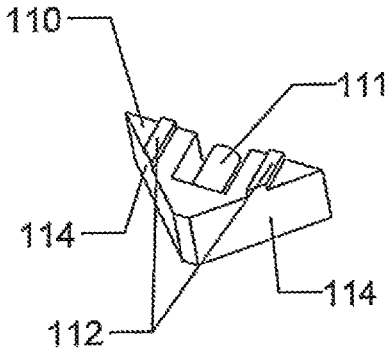
FIG. 11B is a bottom perspective view of the anchoring block shown in FIG. 11A.
Figure 12:
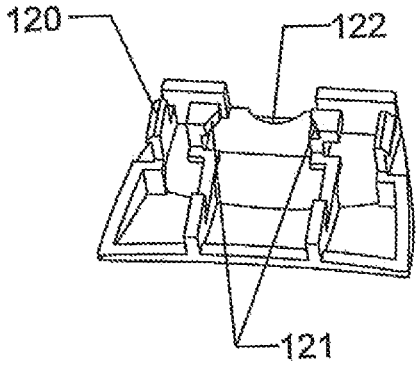
FIG. 12 is a perspective view of a cover plate forming part of the padlock.
Figure 13:
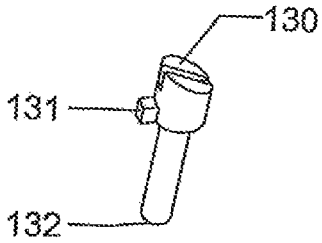
FIG. 13 is a perspective view of a reset button forming part of the padlock.
Figure 17A:
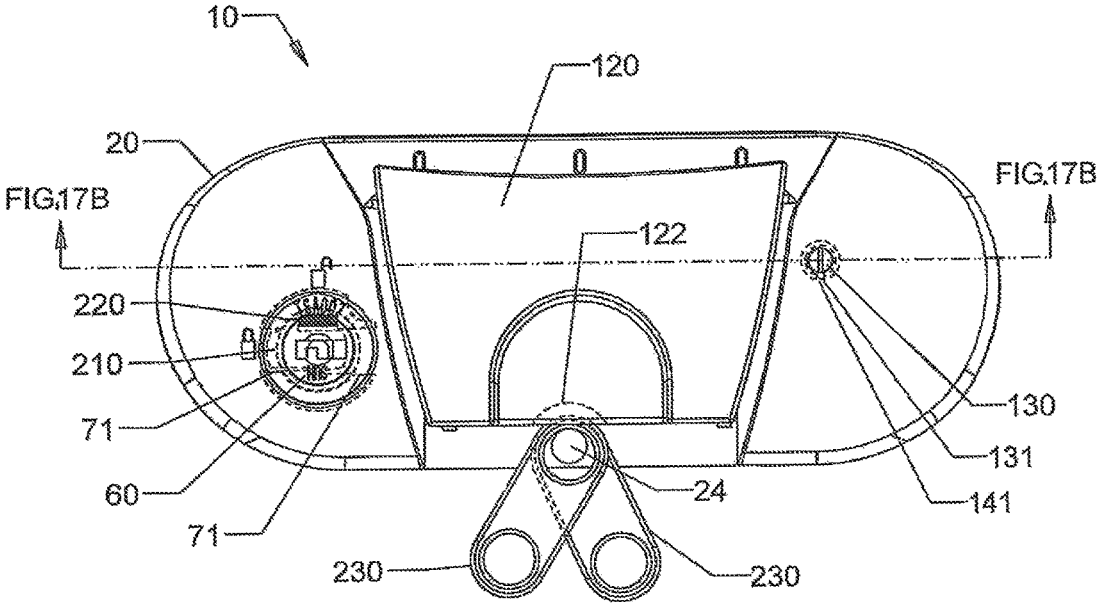
FIG. 17A is a top view of the padlock similar to that shown in FIG. 1A but with the cover plate pulled away from the original position.
Figure 17B:
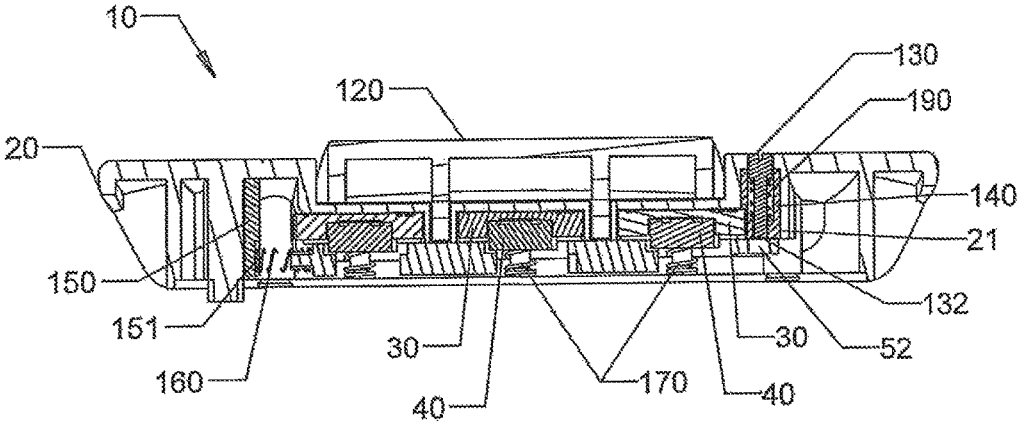
FIG. 17B is a cross-sectional view of the padlock taken along line 17B-17B of FIG. 17A.
Figure 17C:
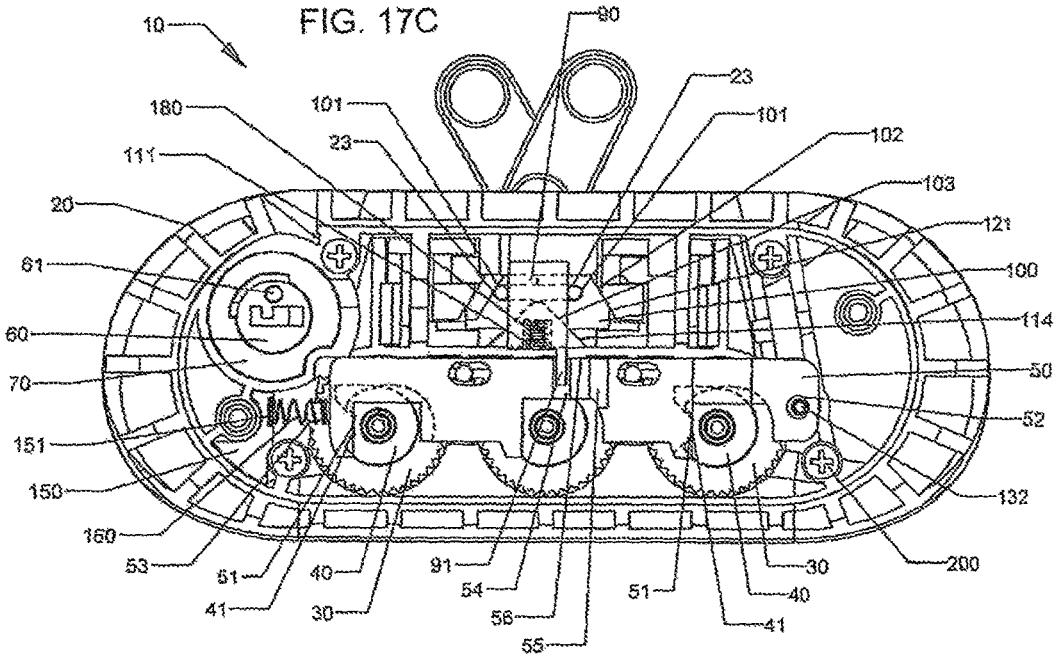
FIGS. 17C-17F are bottom views of the padlock showing interior components and details of its operation with respect to unlocking the padlock using a combination code.
Figure 17D:
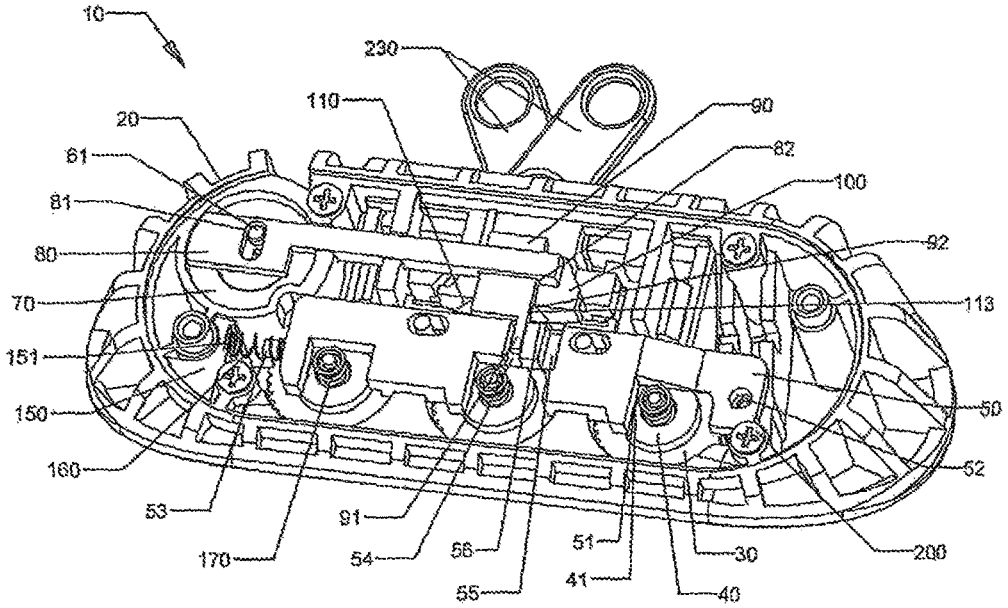
Figure 17E:
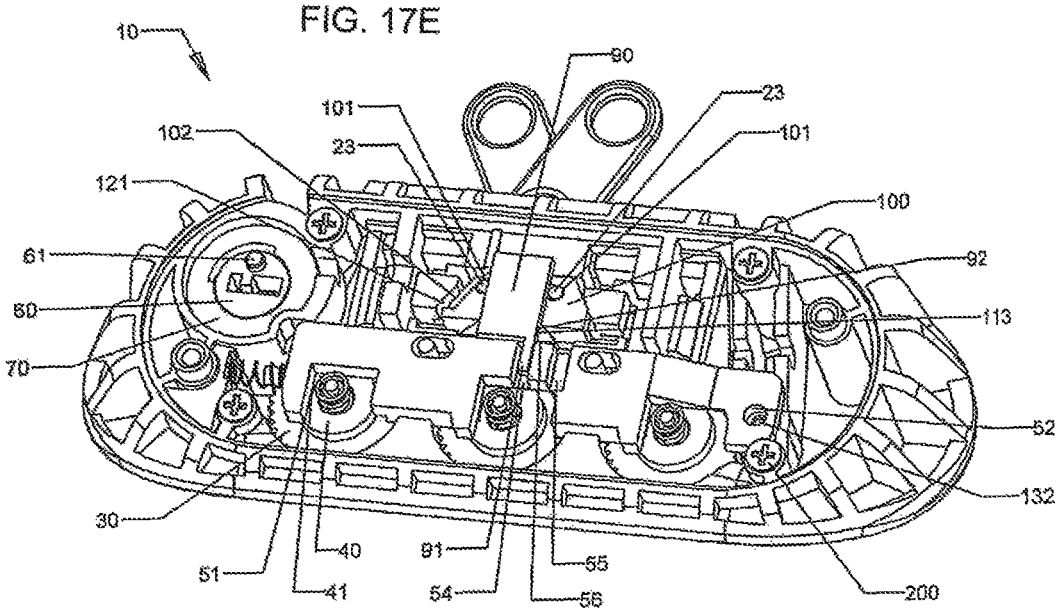
Figure 17F:
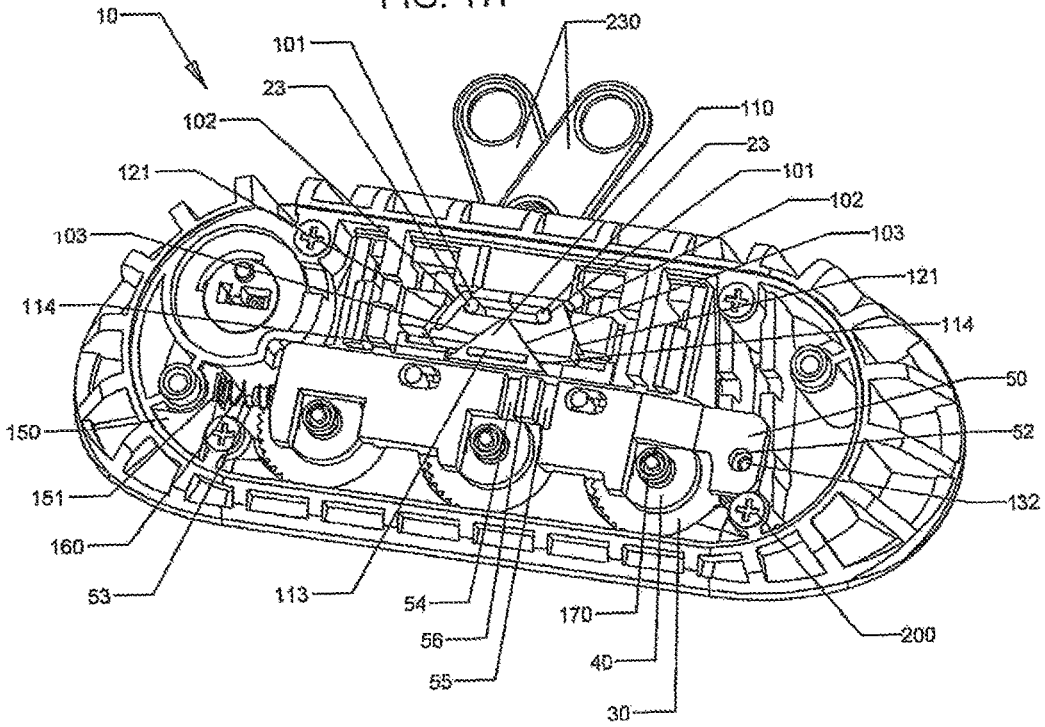

As seen in FIGS. 1F and 11A, the lock 10 has an anchoring block 110. The anchoring block 110 has a block surface 116 and a surface protrusion 113 protruded from the block surface 116. The surface protrusion 113 of the anchoring block 110 is dimensioned to engage with the latch groove 92, but allows the latch 90 to move in the second movement direction when the surface protrusion 113 is engaged with the latch groove 92. The anchoring block 110 has two slope edges 114 and a spring pole 111 dimensioned to receive a spring 180. The spring 180 is positioned to urge the anchoring block 110 against the movement in the first movement direction. The lock 10 has two guide pins 23 fixedly formed in the lock body 20. The lock 10 has two sliding plates 100. Each of the sliding plates 100 has a slot 101 arranged to slidably engage with a guide pin 23 such that the sliding plates 100 can move in the second movement direction, but they cannot move in the first movement direction. Each of the sliding plates 100 has a first sliding slope 103 and a second sliding slope 102. The cover plate 120 has two locking slope surfaces 121, each of the locking slope surfaces 121 arranged to slide against the first sliding slope 103 of one of the sliding plates 100. Each of the slope edges 114 of the anchoring block 110 is arranged to slide against the second sliding slope 102 of one of the sliding plates 100. When the lock 10 is operated in the locked mode, the latch 90 prevents the movement of the anchoring block 110 in the first movement direction and the anchoring block 100 prevents the sliding plates 100 from moving in the second movement direction. As such, the cover plate 120 cannot move away from the fixture pole 24.

As seen in FIG. 1B, the cover plate 120 is mounted on one side of the lock body 20, and a base plate 250 is mounted on the other side of the lock body 20 to conceal the internal mechanism of the lock 10. FIG. 16 shows the base plate 250 which has four openings 252 formed therein to receive four screws 200 for fastening. The locations of the screws 200 can be seen in FIG. 1C, for example. As seen in FIGS. 1B and 1E, the lock 10 also has a plurality of clutch springs 170, each mounted over a clutch 40 to provide an urging force on the clutch 40 toward the associated dial 30. As such, the rotational movement of the dial 30 can be transferred to the clutch 40 when the lock 10 is operated in the locked mode and in the reset mode.

Unlocked by Combination (FIGS. 17A-17F)

When the dials 30 are set to the open-lock combination (the correct combination code), the notch 41 of each of the clutches 40 faces a plate protrusion 51 of the control plate 50. The alignment between the notches 41 and the plate protrusions 51 allows the control plate 50, under the urge of the spring 160, to move in the second movement direction relative to the latch 90. The displacement of the control plate 50 allows the latch finger 91 to move into the first release slot 54 of the control plate 50. Thus, the latch 90, along with the anchoring block 110, can be moved in the first movement direction. As such, the cover plate 120 can be moved in the first movement direction away from the fixture pole 24. As the cover plate 120 moves in the first movement direction, through the sliding contact between the locking slope surface 121 and the first sliding slopes 103 of the sliding plates 100, the sliding plates 100 are forced to move toward each other while they are engaged with guide pins 23. As the sliding plates 100 are moved toward each other, through the sliding contact between the second sliding slopes 102 of the sliding plates 100 and the slope edges 114 of the anchoring block 110, the anchoring block 110 is caused to move in the first movement direction along with the latch 90. The movement of the anchoring block 110 in the first movement direction pushes the latch finger 91 of the latch 90 into the first release slot 54 of the control plate 50. As the cover plate 120 is moved in the first movement direction, the blocking area 122 is moved along to clear the fixture pole 24 so as to change the lock 10 from the locked mode to the unlocked mode. This allows the zipper pulls 230 to be slotted onto the exposed fixture pole 24 or to be taken off from the fixture pole 24.

It should be noted that when the control plate 50 is caused to move in the second movement direction so that the first release slot 54 is aligned with the latch finger 91 of the latch 90, the spring 180 keeps urging the anchoring block 110 against the movement in the first movement direction. As such, the blocking area 122 of the cover plate 120 remains in the blocking position. In order to unlock the lock 10, the user must push the cover plate 120 away from the fixture pole 24 so that the blocking area 122 can clear the fixture pole 24. Once the user releases the cover plate 120, the spring 180 is configured to push the cover plate 120 toward the fixture pole 24 so that the blocking area 122 can move back to the blocking position. Subsequently, the latch finger 91 of the latch 90 is caused to move out of the first release slot 54 of the control plate 50. To re-lock the lock 10, the user must rotate at least one of the dials 30. As the rotational movement of the dial 30 is transferred to the associated clutch 40, the rotational movement of the clutch 40 causes the disengagement of the associated plate protrusion 51 of the control plate 50 from the notch 41. As a result, the control plate 50 is caused to move to the locking position where the blocking wall 56 is in contact with the latch finger 91 of the latch 90.

As seen in FIG. 11A, the anchoring block 100 has two rails 112. As seen in FIG. 1F and FIG. 2, the lock body 20 has two tracks 22 formed therein. The tracks 22 are dimensioned to receive the rails 112 of the anchoring block 100 so as to guide the anchoring block 100 for movement in the first movement direction.

Key Overriding Mechanism (FIGS. 18A-18F)

Figure 6:
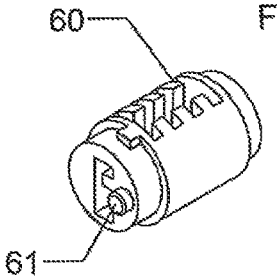
FIG. 6 is a perspective view of a cylinder forming part of the padlock.
Figure 7:
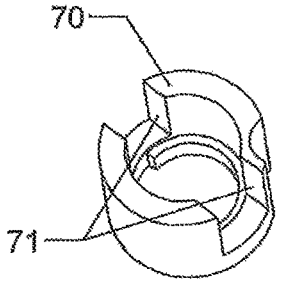
FIG. 7 is a perspective view of the cylinder housing of the padlock.
Figure 8:
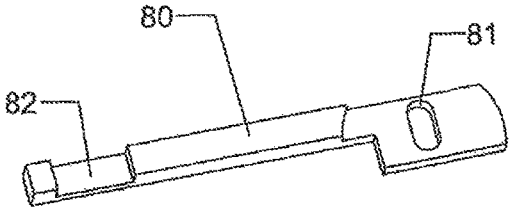
FIG. 8 is a perspective view of a long plate forming part of the padlock.
Figure 9:
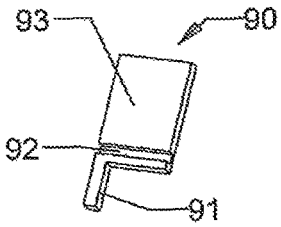
FIG. 9 is a perspective view of a latch forming part of the padlock.
Figure 10A:
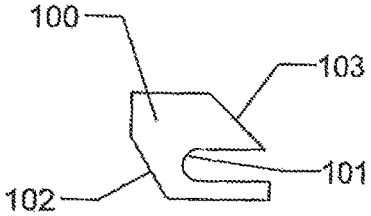
FIG. 10A is a perspective view of a sliding plate forming part of the padlock.
Figure 10B:
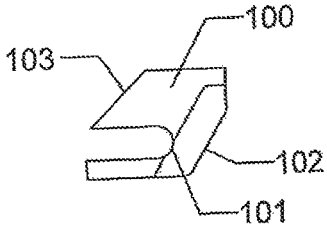
FIG. 10B is an opposite perspective view from that taken in FIG. 10A of the sliding plate.

As seen in FIGS. 18A-18F, the key overriding mechanism comprises a disc tumbler cylinder 60 rotatably mounted in the lock body 20. As seen in FIG. 6, the tumbler cylinder 60 has an extended pin 61 and a key slot 62. The key overriding mechanism also has a linking plate 80. As seen in FIG. 8, the linking plate 80 has a cutout 82 formed in one end of the linking plate 80 and a slot 81 formed in the other end of the linking plate 80. The slot 81 is arranged to moveably engage with the extended pin 61 of the tumbler cylinder 60. The cutout 82 is dimensioned to receive the latch plate 93 of the latch 90 while allowing the latch 90 to move in the first movement direction (see FIGS. 1D and 17D, for example).

While the lock 10 is operated in the locked mode, the latch finger 91 of the latch 90 is in contact with the blocking wall 56 of the control plate 50 (see FIGS. 1D and 1E, for example). A correct key such as key 240 can be used to turn the disc tumbler cylinder 60 so as to change the position of the pin 61 (see FIGS. 1D and 18D). The pin 61 in the changed position causes the shifting of the linking plate 80 toward the other end of the lock body 20. The latch 90 is pushed by the linking plate 80 such that the latch finger 91 is moved away from the blocking wall 56 of the control plate 50 and into alignment with the second release slot 55 while maintaining the engagement with the anchoring block 110. The alignment between the latch finger 91 and the second release slot 55 allows the cover plate 120 to move away from the fixture pole 24.

Figure 18A:
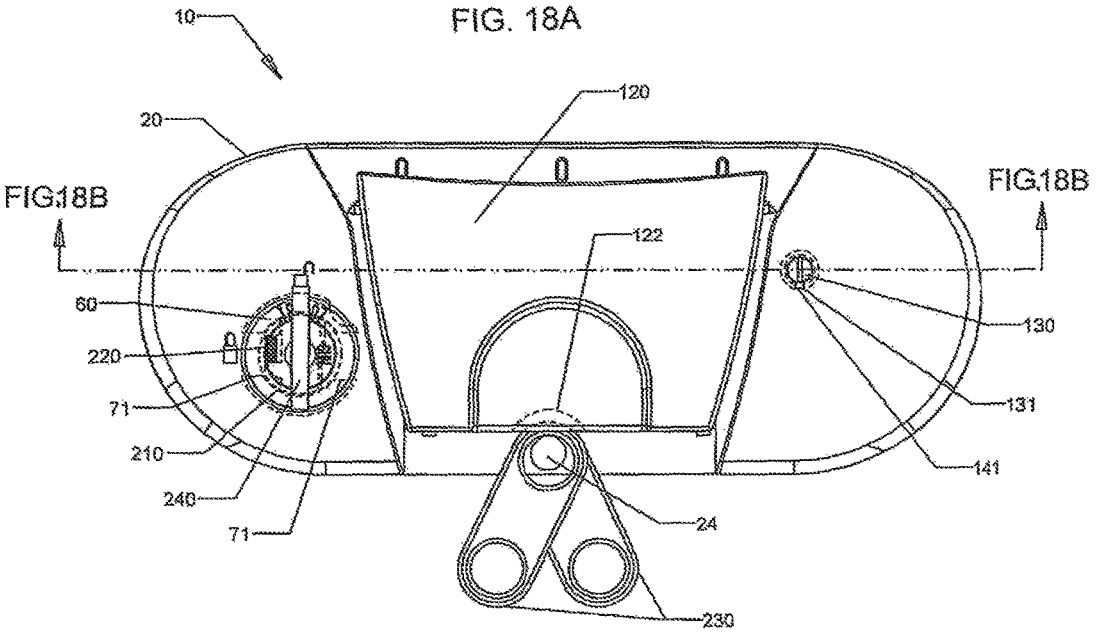
FIG. 18A is another top view of the padlock similar to that shown in FIG. 17A but with a key inserted and turned.
Figure 18B:
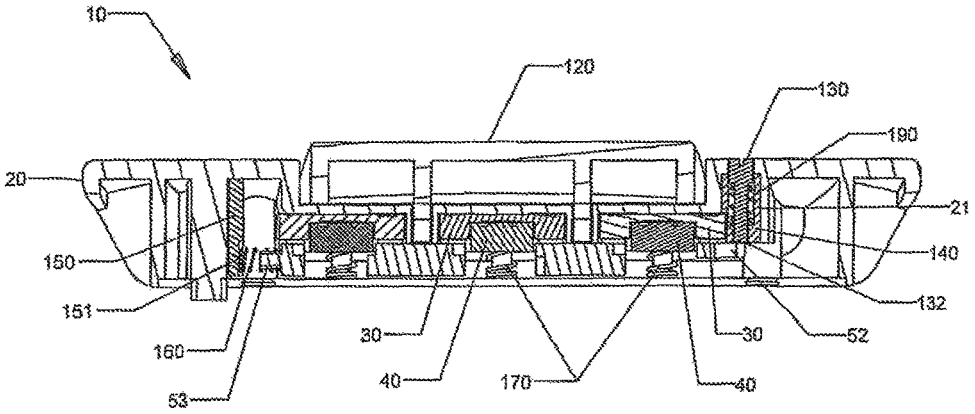
FIG. 18B is a cross-sectional view of the padlock taken along line 18B-18B of FIG. 18A.
Figure 18C:
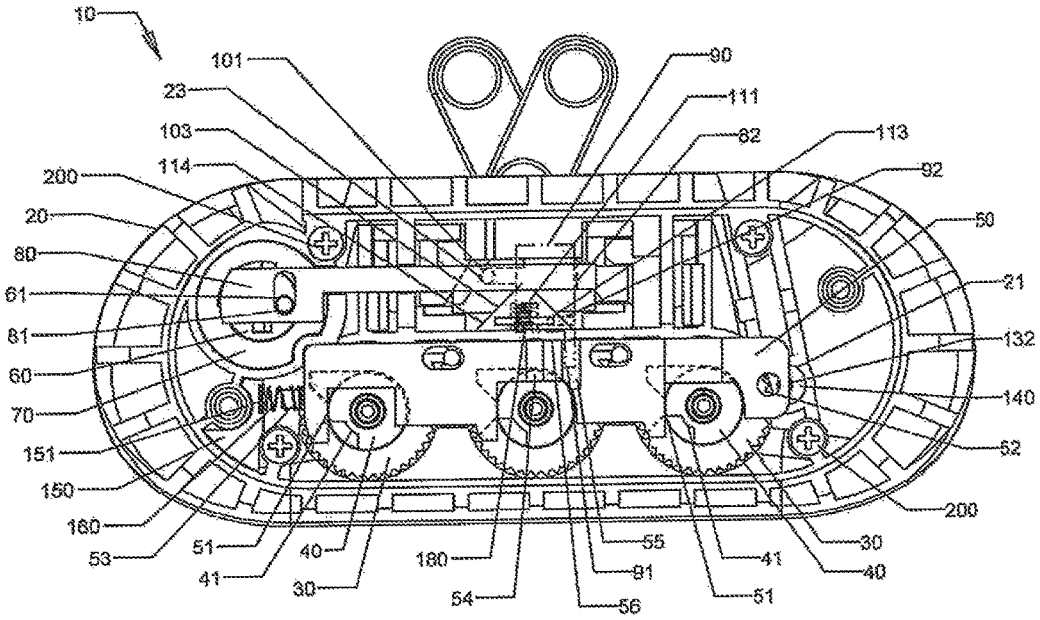
FIGS. 18C-18F are bottom views of the padlock showing interior components and details of the padlock's operation with respect to unlocking by use of a key.
Figure 18D:
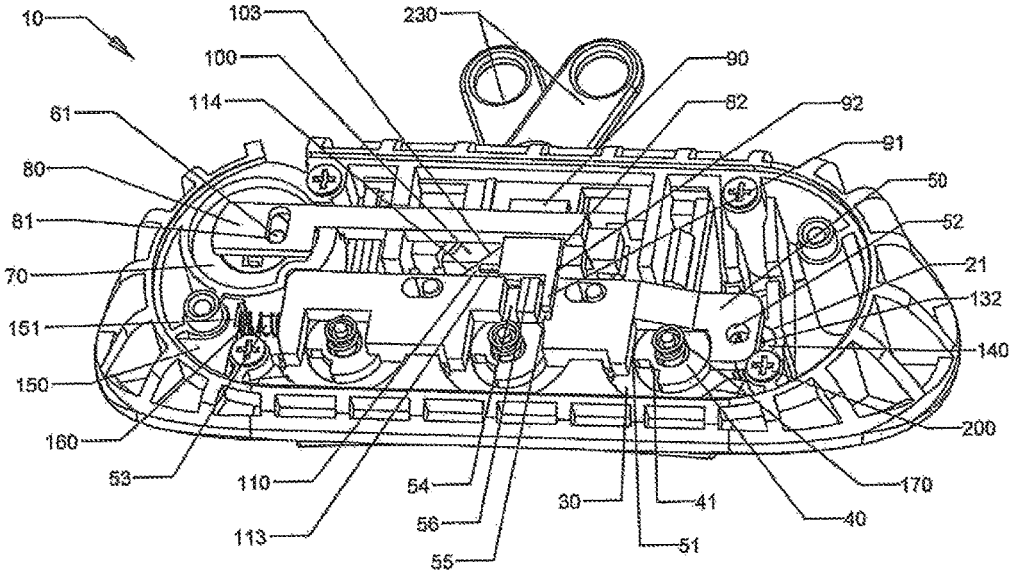
Figure 18E:
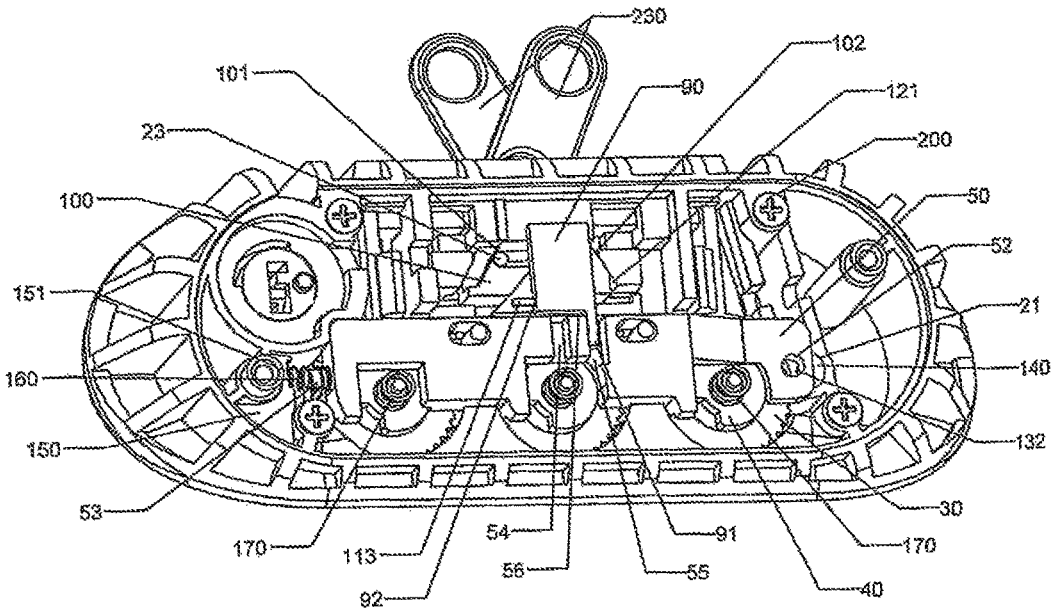
Figure 18F:
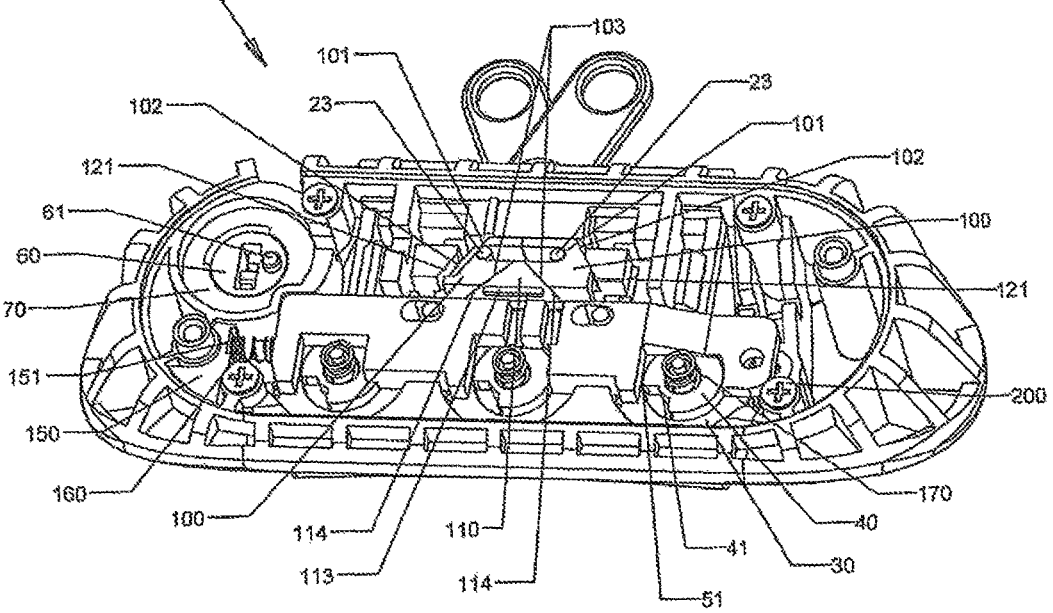

As seen in FIG. 18A, the key 240 is arranged to insert into the key overriding mechanism from the same side of the cover plate 120 and the fixture pole 24. As seen in FIGS. 7, 21, 22A and 22B, the tumbler cylinder 60 is mounted on a cylinder housing 70. The cylinder housing 70 has a wafer slot 71. The tumbler cylinder 60 has a plurality of wafers 210 and a plurality of springs 220, each arranged to provide an urging force on an associated wafer 210. When the tumbler cylinder 60 is in its locking position, the springs 220 are arranged to push the wafers 210 into the wafer slot 71 of the cylinder housing 70, preventing the tumbler cylinder 60 from rotation relative to the cylinder housing 70. When a correct key 240 is inserted into the tumbler cylinder 60, the key 240 forces all of the wafers 210 to retrieve into the tumbler cylinder 60, away from the wafer slot 71 of the cylinder housing 70. The key 240 can then turn the tumbler cylinder 60 relative to the cylinder housing 70 in order to change the position of pin 61.

Reset Mode (FIGS. 19A-19F)

Figure 19A:
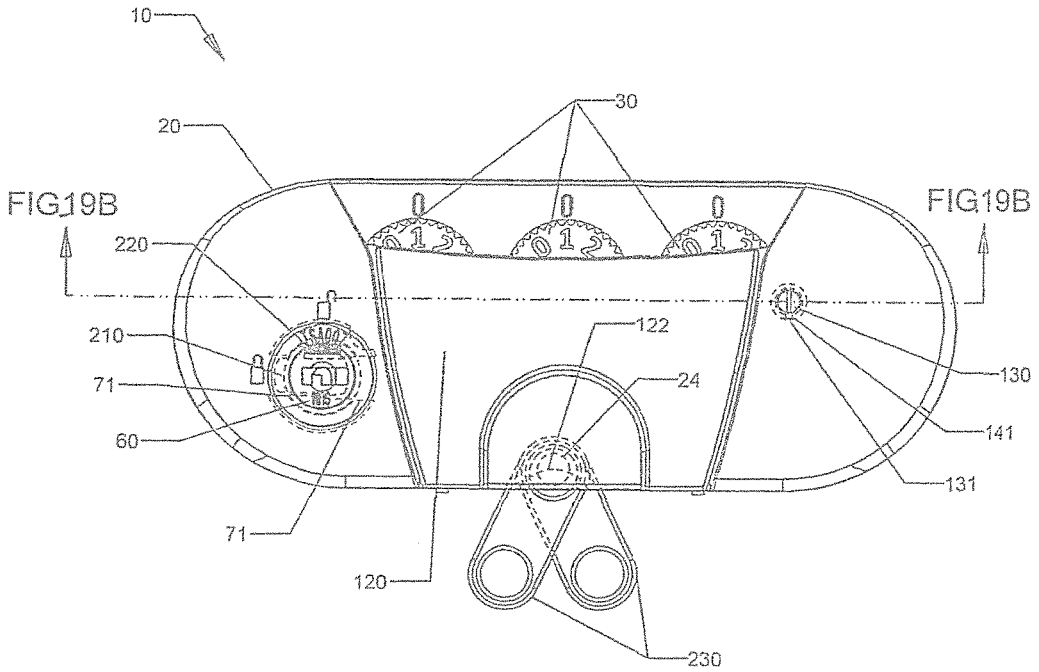
FIG. 19A is a top view of the padlock similar to that shown in FIG. 1.
Figure 19B:
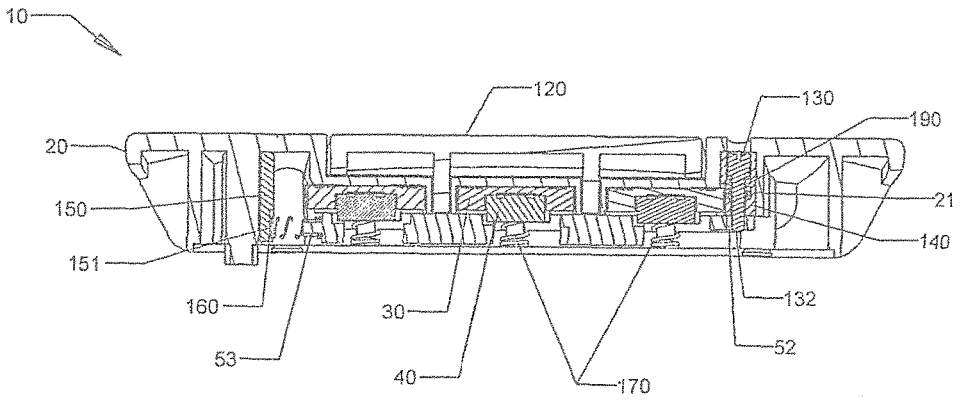
FIG. 19B is a cross-sectional view taken along line 19B-19B of FIG. 19A.
Figure 19C:
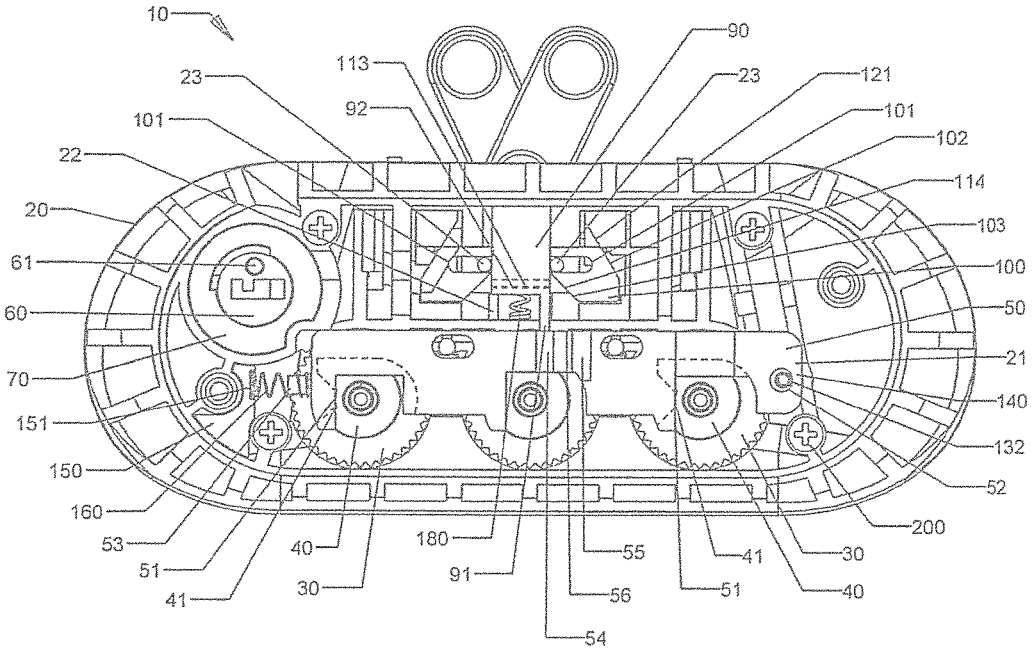
FIGS. 19C-19F are bottom views of the padlock showing interior components and details of the padlock's operation with respect to resetting a combination code for the padlock.
Figure 19D:
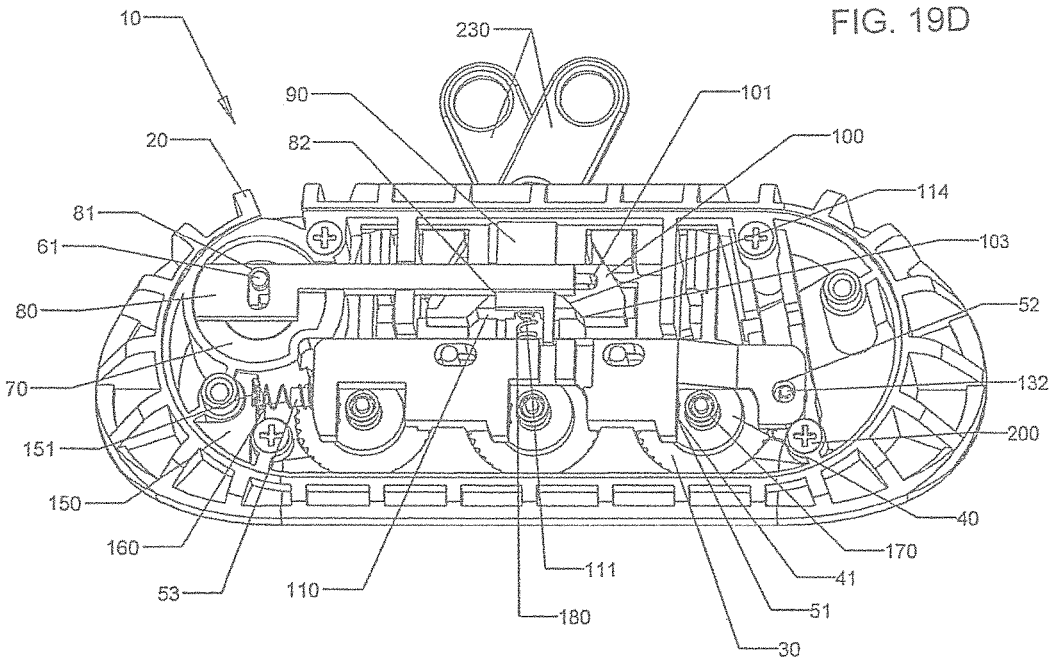
Figure 19E:
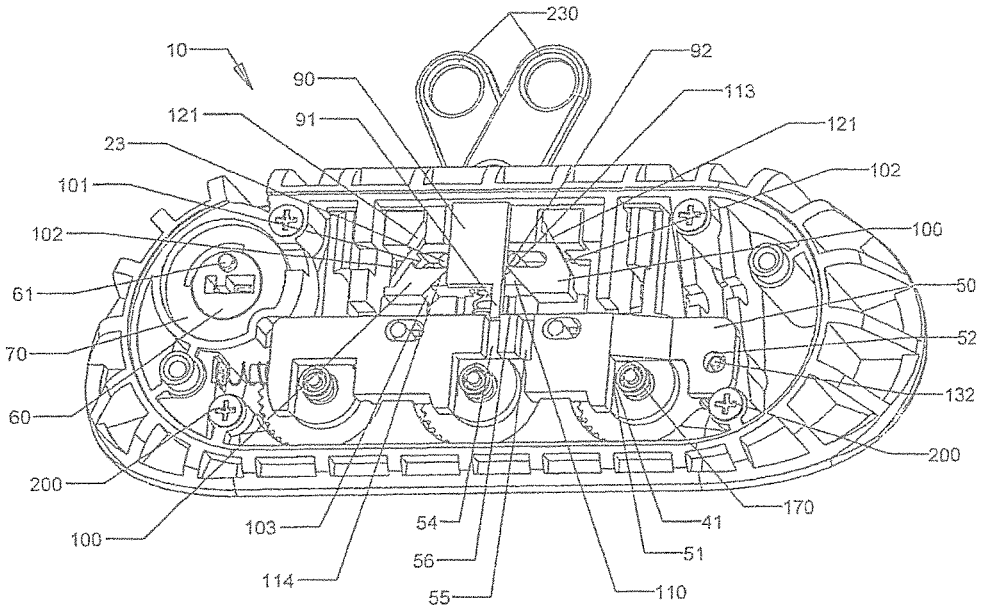
Figure 19F:
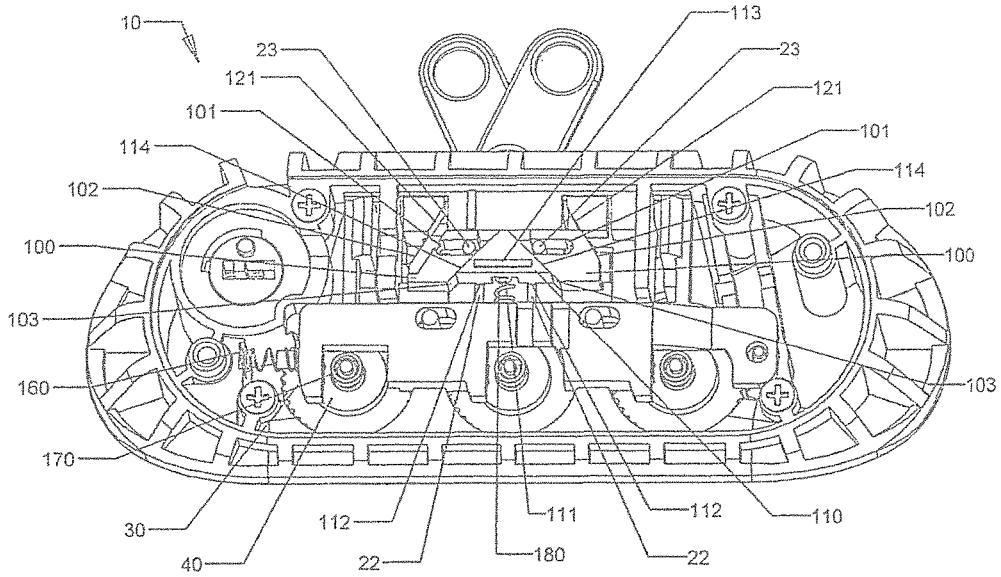
Figure 20A:
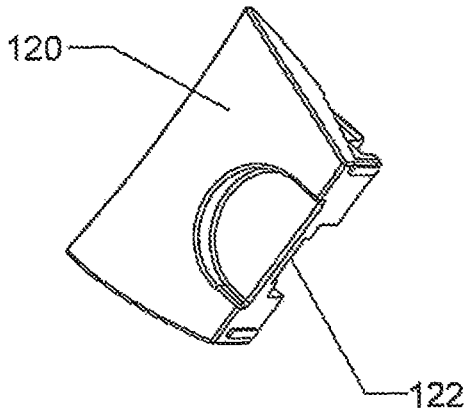
FIGS. 20A-20C are different views of the cover plate.
Figure 20B:
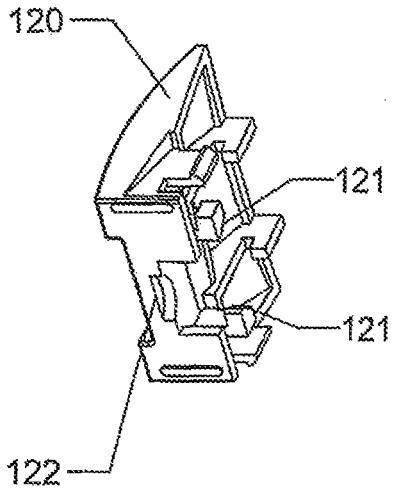
Figure 20C:
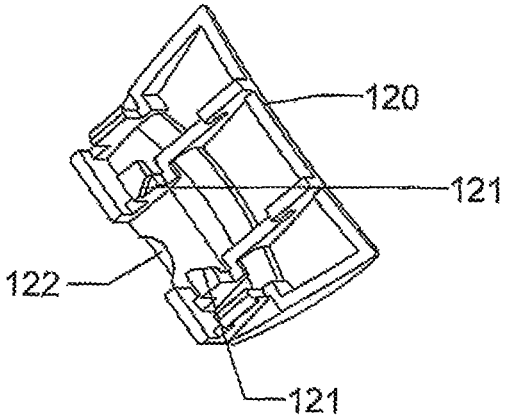
Figure 21:
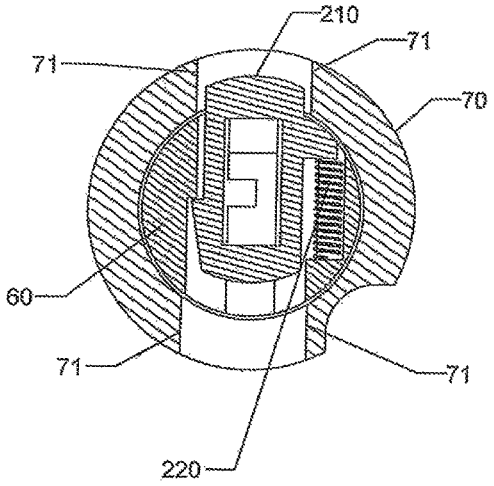
FIG. 21 shows a cross section of the cylinder housing and the cylinder with a wafer and a wafer spring.
Figure 22A:
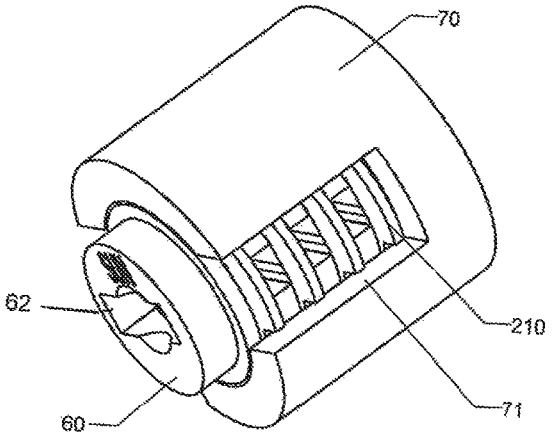
FIGS. 22A and 22B show two perspective views of the cylinder mounted in the cylinder housing.
Figure 22B:
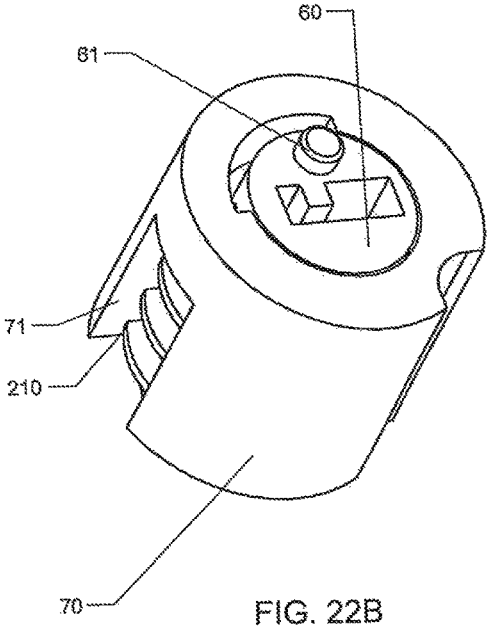

As seen in FIGS. 19A and 19B, the lock body 20 has a code-setting hole 21 dimensioned to receive a plug 140. The plug 140 has an interior chamber arranged to receive a reset button 130 and a reset spring 190. The reset button 130 has a pointer 131 and a tip 132 (see FIG. 13). The plug 140 has a pointer slot 141 dimensioned to movably engage with the pointer 131 of the reset button 130 (see FIG. 14). As seen in FIGS. 1C and 19C, the control plate 50 has a reset hole 52 formed therein. The reset spring 190 inside the interior chamber of the plug 140 keeps the tip 132 of the reset button 130 away from the reset hole 52. When the lock 10 is operated in the locked mode, the control plate 50 is positioned such that the control plate 50 conceals the tip 132 of the reset button 130 (FIG. 1C). When the lock 10 is operated in the unlocked mode, the control plate 50 is positioned such that the reset hole 52 of the control plate 50 is aligned with the tip 132 of the reset button 130. As such, the reset button 130 can be pushed into the reset hole 52 of the control plate 50, preventing the plate protrusions 51 of the control plate 50 from disengaging from the notches 41 of the clutches 40. While the plate protrusions 51 are engaged with the notches 41 of the clutches 40, the user can rotate the dials 30 without rotating the clutches 40 to set a new combination code.

Once the reset button 130 is released, the reset spring 190 in the interior chamber of the plug 140 urges the tip 132 of the reset button 130 to disengage from the reset hole 52 of the control plate 50. After being reset, the lock 10 remains in the unlocked mode until one or more dials 30 are rotated. As the pointer 131 is always located in the pointer slot 141 of the plug 140, the rotational movement of the reset button 130 relative of the plug 140 can be restricted.

In summary, the lock 10 has a fixture pole 24 dimensioned to receive one or more zipper pullers 230 of a zipper case. The lock 10 has a cover plate 120 positioned to block the fixture pole 24 when the lock 10 is operated in the locked mode. The lock 10 has a lock body 20 to house a plurality of dials 30 and a plurality of clutches 40, each clutch 40 associated with a dial 30. A plurality of clutch springs 170 are used to urge the clutches 40 against the dials 30 so that the rotational movement of the dials 30 can be transferred to the associated clutches 40. Each of the clutches 40 has a notch 41. The lock 10 has a control plate 50 positioned in relationship to the clutches 40. The control plate 50 has a plurality of protrusions 51 dimensioned to engage with the notches 41 for movement relative to the clutches 40. The control plate 50 has a first release slot 54, a second release slot 55 and a blocking wall 56 located between the first release slot 54 and the second release slot 55. A latch 90 has a latch plate 93 with a groove 92 formed therein and a latch finger 91 extended from the latch plate 93. The lock 10 has an anchoring block 110 having a surface protrusion 113 dimensioned to engage with the groove 92 of the latch 90. The engagement of the surface protrusion 113 with the groove 92 causes the movement of the latch 90 together with the anchoring block 110 in the first movement direction while allowing the latch 90 to move relative to the anchoring block 110 in the second movement direction. The anchoring block 110 is engaged with the cover plate 120. When the dials 40 are set to the correct combination, the protrusions 51 of the control plate 50 are aligned with the notches 41 of the clutches 40, allowing the control plate 50 to move in the second movement direction and causing the latch finger 91 of the latch 90 to align with the first release slot 54. As such, the latch 90, along with the anchoring block 110, can be moved in the first movement direction and the cover plate 120 can be moved away from the fixture pole 24. The lock 10 has a key overriding mechanism with a disc tumbler cylinder 60 which is moveably connected to a linking plate 80. The linking plate 80 is linked to the latch 90. When the tumbler cylinder 60 is turned by a correct key 240, the linking plate 80 causes the latch 90 to move such that the latch finger 91 is aligned with the second release slot. The alignment allows the anchoring block 110 together with the latch 90 to move in the first movement direction and also allows the cover plate 120 to move away from fixture pole 24.

Although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A lock at least operable in a locked mode and an unlocked mode, comprising:

a lock body;

a pole formed in the lock body;

a cover plate movable in a first movement direction between a first cover position to block the pole and a second cover position to clear the pole;

a latch engageable with the cover plate for movement together in the first movement direction; and a control plate movable in a second movement direction between a first plate position and a second plate position, wherein when the control plate is located in the first plate position, the control plate is configured to restrict movement of the latch and the cover plate, and when the control plate is located in the second plate position, the cover plate is allowed to move from the first cover position to the second cover position together with the latch so as to change the lock from the locked mode to the unlocked mode, wherein the second movement direction is substantially perpendicular to the first movement direction.

2. The lock according to claim 1, wherein the latch comprises a latch plate and a latch finger extended from the latch plate, and the control plate comprises a blocking wall and a release slot, the release slot dimensioned to receive the latch finger, wherein when the control plate is located in the first plate position, the block wall is configured to contact with the latch finger, preventing the latch from moving in the first movement direction, and when the control plate is located in the second plate position, the blocking wall is spaced from the latch finger and the release slot is aligned with the latch finger so as to allow the latch to move in the first movement direction.

3. The lock according to claim 2, further comprising:

an anchoring block movably engaged with the latch, the anchoring block having a block surface and a surface protrusion extended from the block surface, wherein the latch plate has a groove formed therein configured to engage with the surface protrusion so as to restrict movement of the anchoring block relative to the latch in the first movement direction, the groove configured to allow the anchoring block to move relative to the latch in the second direction while the groove is engaged with the surface protrusion.

4. The lock according to claim 3, further comprising:

two guiding pins fixedly formed in the lock body in relationship to the pole, and two sliding plates, each sliding plate having a slot formed therein dimensioned to slidably engage with a different one of the guiding pins for movement in the second movement direction, each of the sliding plates further having a first sliding edge and a second sliding edge, wherein the cover plate comprises two locking-slope surfaces, each locking-sloping surface arranged to contact with the first sliding edge of a different one of the sliding plates, and wherein when the cover plate is caused to move in the first direction away from the pole, the sliding plates are caused to move closer to each other in the second direction, and wherein the anchoring block comprises two slope edges, each slope edge arranged to contact with the second sliding edge of a different one of the sliding plates and when the sliding plates are caused to move closer to each in the second direction, the anchoring block is also caused to move in the first direction away from the pole.

5. The lock according to claim 4, wherein when the control plate is located in the first plate position, the latch is prevented from moving in the first movement direction together with the anchoring block, and the sliding plates are prevented from moving closer to each other in the second direction so as to prevent cover plate from moving away from the pole in the first movement direction, and when the control plate is located in the second plate position, the latch is allowed to move in the first movement direction together with the anchoring block, and the sliding plates are allowed to move closer to each other in the second direction so as to cause the cover plate to move from the first pate position to the second plate position to clear the pole.

6. The lock according to claim 4, further comprising a spring arranged to urge the anchoring block against movement in the first movement direction so as to keep the cover plate in the first plate position when the lock is operated in the unlocked mode.

7. The lock according to claim 3, wherein the control plate further comprises a further release slot dimensioned to receive the latch finger, the lock further comprising:

a key overriding mechanism configured to move the latch plate in the second movement direction relative to the control plate when the lock is operated in the locked mode so as to move the latch finger away from the blocking wall and into alignment with the further release slot, allowing the latch to move in the first movement direction.

8. The lock according to claim 7, wherein the key overriding mechanism comprises a tumbler cylinder and a linking plate movably connected to the tumbler cylinder, the linking plate comprising a cutout formed therein configured to receive the latch plate, the tumbler cylinder rotatable between a first cylinder position and a second cylinder position, wherein when the tumbler cylinder is maintained in the first cylinder position, the latch finger is positioned to contact with the blocking wall, and when the tumbler cylinder is caused to move from the first cylinder position to the second cylinder position, the linking plate is configured to move the latch plate into alignment with the further release slot.

9. The lock according to claim 8, wherein the tumbler cylinder has a tumbler surface and a pin fixedly formed on the surface, and the linking plate further comprises a slot configured to movably engage with the pin, and wherein when the tumbler cylinder is caused to move from the first cylinder position to the second cylinder position, the pin is configured to move the linking plate in the second movement direction together with the latch plate.

10. The lock according to claim 1, wherein the control plate comprises a plate spring and a plurality of plate protrusions, said lock further comprising:

a plurality of rotatable clutches, each associated with one of the plate protrusions, each clutch having a notch formed therein configured to receive the associated plate protrusion, wherein when the notch in each of the clutches is aligned with the associated plate protrusion, the plate spring is configured to urge the control plate to move from the first plate position to the second plate position, and when the notch in any one of the clutches is misaligned with the associated plate protrusion, the control plate is prevented from movement.

11. The lock according to claim 10, further comprising:

a plurality of clutch springs; and a plurality of dials, each of the dials associated with a different one of the clutches, wherein the clutch springs are configured to urge the clutches against the associated dials so that a rotational movement of the dial is transferred to the associated clutch when the lock is operated in the locked mode, wherein each of the dials comprises a substantially circular disc having indicia thereon and the indicia on the dials are arranged to a combination code for operating the lock in the unlocked mode.

12. The lock according to claim 1, wherein the lock is configured to securely retain at least one zipper pull tab of a zipper case, wherein the at least one zipper pull tab comprises an opening formed therein, the opening dimensioned for insertion onto the pole when the cover plate is located in the second plate position to clear the pole, and wherein when the cover plate is located in the first plate position, the cover plate is configured to securely retain the at least one zipper pull tab to the lock.

* * * * *